US006192893B1

(12) United States Patent
Katsumata

(10) Patent No.: US 6,192,893 B1
(45) Date of Patent: Feb. 27, 2001

(54) HAIR FASHION ACCESSORY

(75) Inventor: Yoshinori Katsumata, Tanashi (JP)

(73) Assignee: Katsumata Spring Co., Ltd. (JP)

( * ) Notice: Subject to any disclaimer, the term of this patent is extended or adjusted under 35 U.S.C. 154(b) by 0 days.

(21) Appl. No.: 09/616,775

(22) Filed: Jul. 14, 2000

(30) Foreign Application Priority Data

Jul. 19, 1999 (JP) ..... 11-202379

(51) Int. Cl.[7] ..... A45D 8/34
(52) U.S. Cl. ..... 132/273
(58) Field of Search ..... 132/273, 275; 267/166, 286; D28/40, 39; D11/20

(56) References Cited

U.S. PATENT DOCUMENTS

D. 302,252 * 7/1989 Sykes .
1,172,948 * 2/1916 Millea .
1,349,079 * 8/1920 Markham .
1,862,992 * 6/1932 Vargha .
2,547,295 * 4/1951 Weeks .
2,924,228 * 2/1960 McGee .
5,271,421 * 12/1993 Videtzky .
5,878,755 * 3/1999 Crabtree et al. ..... 132/273

* cited by examiner

*Primary Examiner*—Jeffrey A. Smith
(74) *Attorney, Agent, or Firm*—Steinberg & Raskin, P.C.

(57) ABSTRACT

A challenge of the present invention is to provide a hair fashion accessory which is not removed easily from hair once it is fastened to the hair. For solution to the challenge, in the hair fashion accessory comprising a coil spring made of a wire material for a spring to catch hair in spaces between winds of the wire material for holding the hair, the coil spring is formed in a polygonal column with helical side edges.

1 Claim, 3 Drawing Sheets

*Fig.5* *Prior Art*
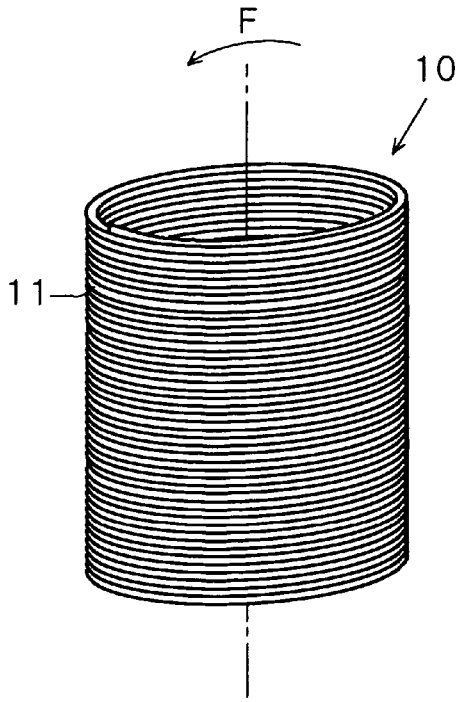
*Fig.6* *Prior Art*
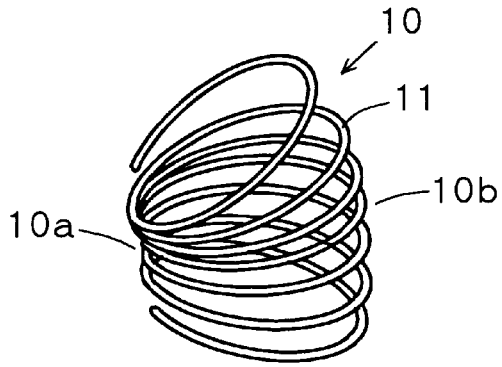

HAIR FASHION ACCESSORY

BACKGROUND OF THE INVENTION

1. Field of the Invention

This invention relates to a spring shaped hair fashion accessory for holding hair with dressing up hair decoratively.

2. Description of Related Art

As hair fashion accessories, for example, there is a coil shaped hair fashion accessory 10 shown in FIG. 5. The hair fashion accessory 10 comprises a coil spring formed of a stainless made wire material 11 as illustrated in FIG. 5. Hair is caught in spaces between winds of the coil-spring wire material 11 to fasten the hair fashion accessory.

As illustrated in FIG. 6, the hair fashion accessory 10 curves when receiving a force orthogonal to the axis of the coil spring, or a force F in the direction of the arrow shown in FIG. 5. At this time, the ring of wire material 11 on the constriction side 10*a* shifts in the axial direction to bend the cylindrical column of the coil spring. This allows an extending side 10*b* to increase spaces between winds of the coiled wire material 11.

These opened-up spaces formed in the wire material 11 release the clamping hair, to remove the hair fashion accessory 10 from the hair.

If hair swings while the hair fashion accessory 10 actually is holding the hair, then the hair fashion accessory 10 receives forces in various directions, including the force F in the direction of bending the coil spring. The force F may easily remove the hair fashion accessory 10 from the hair.

SUMMARY OF THE INVENTION

It therefore is an object of the present invention to provide a hair fashion accessory that does not come easily apart from hair once it holds the hair.

The present invention has a feature for a hair fashion accessory which comprises a coil spring made of a wire material for a spring to catch hair in spaces between winds of the wire material for holding the hair, in that the coil spring is formed in a polygonal column with helical side edges.

According to the present invention, the coil shaped hair fashion accessory for holding hair is adapted to be removed easily from the hair.

The hair fashion accessory enhances the effect of ornamenting with a stylish appearance, which is not produced by a typical coil spring.

BRIEF DESCRIPTION OF THE DRAWINGS

FIG. 5 is a perspective view of prior art.

FIG. 6 illustrates a state in which a hair fashion accessory of the prior art is bent.

DETAILED DESCRIPTION OF THE PREFERRED EMBODIMENT

FIGS. 1 to 4 show a preferred embodiment of a hair fashion accessory according to the present invention.

Figure 2:
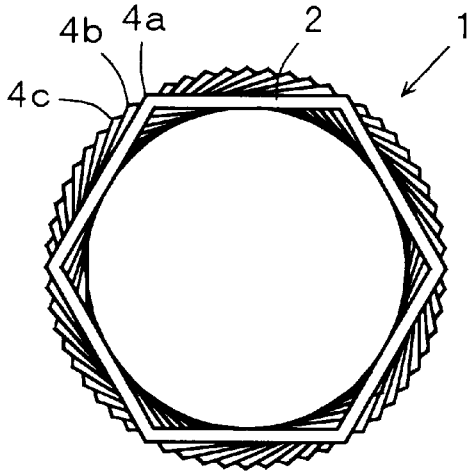
FIG. 2 is a side view of the embodiment.

The hair fashion accessory 1 comprises a coil spring formed using a spring wire material 11. The appearance of the hair fashion accessory 1 is a configuration such that a hexagonal column having two end faces 2 of approximately equilateral hexagonal section is twisted about its axis. Viewing in a side view, side edges 3 of the hexagonal column are in a helical fashion. Seeing from the end face 2, the hair fashion accessory 1 has a shape such as, as illustrated in FIG. 2, a lot of hexagons formed with the spring wire material 11 overlap one another, with their tops 4*a*, 4*b*, 4*c*, . . . , being slightly displaced from one another in the perimeter direction.

The above hexagon is not an equilateral hexagon in the strict sense because the hair fashion accessory 1 is formed continuously with one wire material 11. FIG. 2 shows a view where the individual equilateral hexagons overlap one another for easier understanding. In FIG. 2, the top 4*a* is a top of the topmost hexagon of the overlapping hexagons, the top 4*b* is a top of the second hexagon and the top 4*c* is a top of the third hexagon.

The above coil spring has a minimum length in unloading, in which each space between winds of the wire material 11 is next to nothing. Similar to the prior art, such hair fashion accessory 1 is fastened to hair by catching the hair in the wire material 11. Specifically, when the hair fashion accessory 1 holds hair, the spring is extended, to produce a resilient force of the coil spring in the direction of compressing the hair. The hair fashion accessory 1 is fastened to the hair with the resilient force.

Next, concerning a case where force F exerts on the hair fashion accessory 1 in the direction of bending it.

Figure 1:
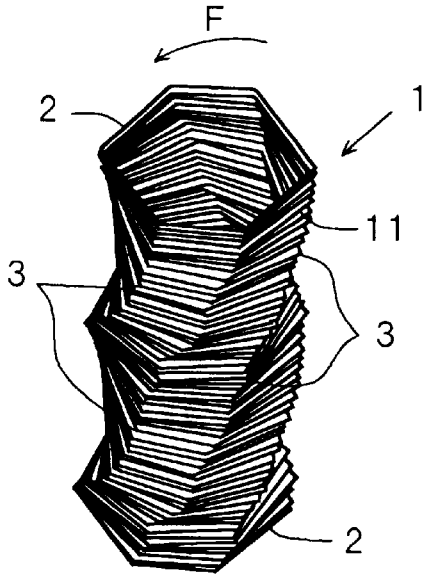
FIG. 1 is a perspective view of an embodiment of a hair fashion accessory according to the present invention.
Figure 3:
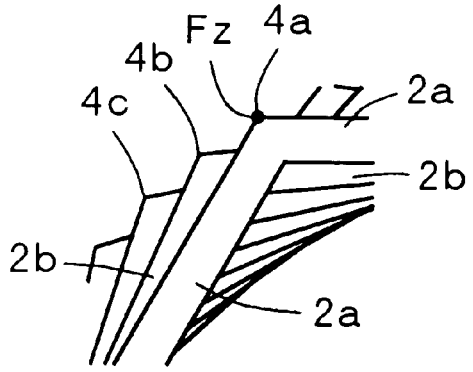
FIG. 3 is a fragmentary enlarged view of FIG. 2.

Upon acting of the force F shown in FIG. 1 or force F in the direction of bending the hair fashion accessory 1, a downward force Fz as component of the force F acts on the top 4*a* of one of the hexagons shown in FIG. 3 of the partially enlarged view of FIG. 2. As the force Fz shifts the position of the top 4*a* in the longitudinal direction, spaces are produced on the opposite side from the top 4*a*.

With the above hair fashion accessory 1, however, the hexagons overlay such that they are displaced slightly from each other in the perimeter direction. As shown in FIG. 3, hence, sides 2*a*, 2*a* between which the top 4*a* is interposed are supported by crossing sides 2*b*, 2*b* of a hexagon beneath the respective sides 2*a*. Similarly, the sides 2*b* in turn cross respective sides beneath the sides 2*b* for supporting.

For such crossing of the sides of hexagons, when the force F exerts in the direction of bending the axis of the coil spring, the individual sides support the respective sides positioned beneath them, to distribute the force in the perimeter direction. This results in a hard-to-bend coil spring.

Figure 4:
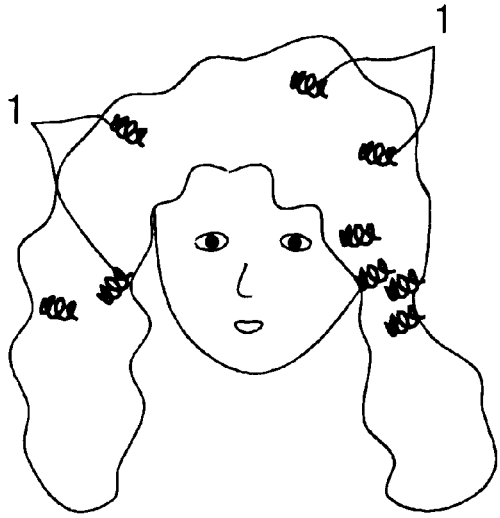
FIG. 4 illustrates an example of attaching the hair fashion accessories of the embodiment on hair.

As illustrated in FIG. 4, even in wearing the hair fashion accessories 1 at many positions on hair, the hair fashion accessory 1 is not bent by such a force that is produced by swinging of the hair, and thus is not removed from the hair.

It is possible for the hair fashion accessory 1 to hold hair to make up a bundle/bundles of the hair as well as use as ornaments.

The foregoing embodiment has been described for the twisted hexagonal column, but a hair fashion accessory of the present invention may be shaped in any twisted polygonal column of polygonal cross-section, such as a triangular column and a rectangular column—regardless of the number of sides of polygon cross-section, having helical-shaped side edges, by way of example. If a coil spring is shaped in a twisted polygonal column, the sides of the polygons can overlay to cross one another. This allows the force exerting in the direction of bending the coil spring to be distributed in the peripheral direction. Resulting in an effect that a hair fashion accessory is not easily bent.

It should be mentioned that a size of the polygon and a length of the column are not limited. A large-sized hair fashion accessory is useful for making up a bundle of hair, while a small-sized one is suitable when being fastened in plurality on hair to be used as ornaments.

Moreover, concerning a helix angle of the polygonal column a variety of ways is possible. One hair fashion accessory is not required to have a constant helix angle. A helical direction of a hair fashion accessory may be reversed at a certain point in the longitudinal direction.

As described in the foregoing embodiment of the hair fashion accessory 1, a hair fashion accessory according to the present invention has a structure of twisted polygonal column, thereby preventing the hair fashion accessory from easily and unnecessarily removing from hair. In addition, the twisted configuration has peculiar effects of ornaments. The helical side edges produce delicate shades of viewing on the side faces, which are not produced by a simple shape of a circular or polygonal column. A user can enjoy oneself at the hair fashion accessories of a variety of appearances produced by various combinations of a cross-sectional area and length of the coil and a helix angle.

For example stainless steel for a spring is appropriate for a material of the hair fashion accessory. The material can be coated with gold plating or colored by a variety ways. The gold plating provides a quality appearance and improves resistance to tarnish.

What is claimed is:

1. A hair fashion accessory including a coil spring made of a wire material for a spring to catch hair in spaces between winds of said wire material for holding the hair, wherein said coil spring is formed in a polygonal column with helical side edges.

* * * * *

UNITED STATES PATENT AND TRADEMARK OFFICE

CERTIFICATE OF CORRECTION

PATENT NO. : 6,192,893 B1
DATED : February 27, 2001
INVENTOR(S) : Yoshinori Katsumata It is certified that error appears in the above-identified patent and that said Letters Patent is hereby corrected as shown below:

Title page,
Item [30] FOREIGN APPLICATION PRIORITY DATA should read --

Jul. 16, 1999 (JP).....11-202379 --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*